United States Patent [19]

Cermignani et al.

[11] 4,186,400

[45] Jan. 29, 1980

[54] AIRCRAFT SCANNING ANTENNA SYSTEM WITH INTER-ELEMENT ISOLATORS

[75] Inventors: Justine D. Cermignani, Fort Salonga; Frederick M. Ganz, Nesconset, both of N.Y.

[73] Assignee: Grumman Aerospace Corporation, Bethpage, N.Y.

[21] Appl. No.: 911,465

[22] Filed: Jun. 1, 1978

[51] Int. Cl.[2] ..... H01Q 1/28; H01Q 3/26

[52] U.S. Cl. ..... 343/708; 343/817; 343/854

[58] Field of Search ..... 343/712, 713, 714, 715, 343/812, 813, 814, 815, 816, 854, 705, 708

[56] References Cited

U.S. PATENT DOCUMENTS

| | | | |
|---|---|---|---|
| 2,409,944 | 10/1946 | Loughren | 343/854 |
| 2,485,138 | 10/1949 | Carter | 343/819 |
| 2,558,727 | 7/1951 | Bernet | 343/817 |
| 2,629,865 | 2/1953 | Barker | 343/8 |
| 3,373,434 | 3/1968 | Lorenzo et al. | 343/815 |
| 3,541,559 | 11/1970 | Evans | 343/798 |
| 3,836,977 | 9/1974 | Wheeler | 343/815 |
| 4,131,896 | 12/1978 | Miller | 343/909 |

*Primary Examiner*—Eli Lieberman

*Attorney, Agent, or Firm*—Bruce B. Brunda; Richard G. Geib

[57] ABSTRACT

An antenna system is provided having a common reflector and a plurality of spaced apart end-fired yagi type elements each comprising a driver and one or more directors. The elements are positioned longitudinally parallel to each other in separate planes. Adjustable parasitic reflecting rods are located adjacent to the elements so as to cause the generation of a low energy scattering field which, in turn, increases inter-element isolation.

15 Claims, 14 Drawing Figures

AIRCRAFT SCANNING ANTENNA SYSTEM WITH INTER-ELEMENT ISOLATORS

BACKGROUND

This invention relates to an H-plane electronically scanned yagi antenna system. More particularly, the invention relates to an antenna system which includes parasitic reflecting rods to broaden the H-plane element pattern to provide electronic scanning over a ninety degree (90°) angular sector. The proposed system is suitable for use in aircraft installations where vertical space is limited such as in the edges of an airfoil. One specific application is for Information Friend or Foe (I.F.F.) antenna systems, where a vertically polarized beam is required.

In general, the use of multiple antenna elements in an array provides improved directivity and antenna gain in a system adaptable to electronic scanning wherein the beam axis is scanned by controlling the phase of the radio signals used to excite the individual antenna elements.

Antenna arrays, however, present problems absent in non-arrayed systems. Preferably, the individual elements of the array should be as closely spaced as possible, consistent with the desired gain and directivity of the beam, to maintain the compactness of the system and prevent grating lobes. This close spacing, however, makes it difficult to avoid inter-element "feed through" where radiation from one driver tends to be received by neighboring drivers. An electrical current is thereby induced in the neighboring channel through its respective antenna port. This current tends to introduce irregularities into the channels's feed line and signal processing system. Consequently, this inter-element coupling has a substantial impact on the radiation pattern and results in an overall degradation of the system response.

As mutual coupling increases, inter-element isolation is reduced and the antenna becomes less effective due to the element pattern mismatch and resulting reflections emanating therefrom. Non-uniformities in the array field develop which induce variations in element input impedance as the beam point direction changes. When transmitting, this impedance variation produces a mismatch between the antenna impedance and the signal generator impedance, thereby reducing maximum power transfer. On receive, the apparent impedance mismatch results in received signals being partially reflected back into space by the antenna. In either case, both antenna pattern and power gain (or efficiency) are adversely affected.

In order that the antenna array present a uniform impedance and exhibit radiation uniformity, it is desirable (if not a prerequisite) that the in-array element pattern have a smooth contour and that its relative gain be substantially constant over the scanning angle to be serviced. This radiation uniformity can be obtained, and is obtained in the present invention, by substantial elimination of energy loss due to inter-element feed through, thus allowing this energy to be reradiated as is desired.

In the past, reduction or elimination of inter-element coupling has been sought by the placement of metal septa between elements to block or inhibit energy transfer between such elements. These septa form metal planes extending from the reflector (in the yagi array) to the forward director. The use of such metallic septa between elements is not an acceptable solution to the problem for several reasons. The major limitation to this technique is that it restricts the angular sector over which the array may be scanned due to the effects of both diffraction and mode elimination.

While the metallic septa are useful in reducing mutual coupling between adjacent drivers, they also act as waveguides which limit the modes of propagation excitable by the antenna. As modes of propagation become suppressed, nonuniformities in the system response develop. This limits the angular sector through which the system can effectively operate thereby rendering this construction unacceptable for wide-angle scanning applications.

Another undesirable consequence of the use of metallic septa is the introduction of diffraction effects into the field pattern. As with the limitation of modes of propagation, the result is a degradation of the field pattern and a corresponding reduction in angular scanning capacity of the system.

The use of various other techniques to increase inter-element isolation such as balancing the feed line have also been proposed as a means for stabilizing the element impedance over a wide-angle of operation. These techniques compensate for the effects of inter-element coupling by electronic processing of the signal at a location some distance from the antenna. This procedure produces satisfactory results in some applications, yet the space and weight requirements of the balancing device make it inappropriate for use in numerous situations.

The present invention, however, calls for an H-plane array wherein the elements are parallel to each other rather than adjacent. This antenna construction results in a mutual coupling field broadside to the elements rather than at the element ends. Many previous antenna construction techniques concerned with coupling between adjacent elements are thus ineffective in an H-plane array.

Techniques involving the use of parasitic reflectors in scanning systems have been proposed in the U.S. Pat. No. 2,409,944 issued to Loughren and U.S. Pat. No. 2,629,865 issued to Barker. In both cases, involving E-plane arrays, the parasitic elements were used as reflectors to increase the directivity of the dipoles in desired direction of radiation. In so doing, the depth of each element is increased while the problem of maximizing array element isolation is not addressed.

Accordingly, principle objects of the invention are to provide increased antenna coverage and improved power transfer characteristics in antenna array systems that are electronically scanned in the H-plane.

Other objects of the invention include providing an antenna array system having low mutual electromagnetic coupling between individual antenna elements and having smooth in array element patterns and relatively high and uniform gain over a finite bandwidth.

SUMMARY OF THE INVENTION

In general, the foregoing objects and advantages are obtained by locating the drivers, directors, and parasitic reflecting rods of an array of yagi type antenna elements so as to minimize feed through to ports of adjacent elements in an H-plane array. In its simplest form, the antenna comprises one or more parasitic reflecting rods located in spaced parallel relation to an array of yagi elements arranged in the H-plane, each element including a driver, one or more directors and a reflector common to all elements.

Preferably, the parasitic reflecting rods are of adjustable length and location from the ground plane as to create a scattering electromagnetic field at an intensity and at a phase which substantially increases inter-element isolation, thereby permitting broad scanning in the H-plane.

Reference is now made to the following detailed description of preferred embodiments, taken in conjunction with the accompanying drawings.

DETAILED DESCRIPTION OF THE DRAWINGS

Figure 1:
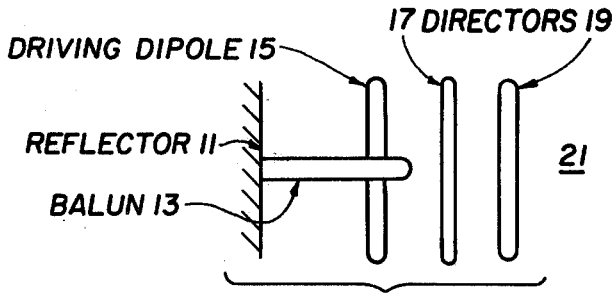
FIG. 1 is a representation of a conventional yagi end-fire antenna element.

FIG. 1 is a representation of a conventional end-fired yagi type element 21 including common reflector 11, balun 13, driving dipole 15 and directors 17 and 19.

Figure 2A:
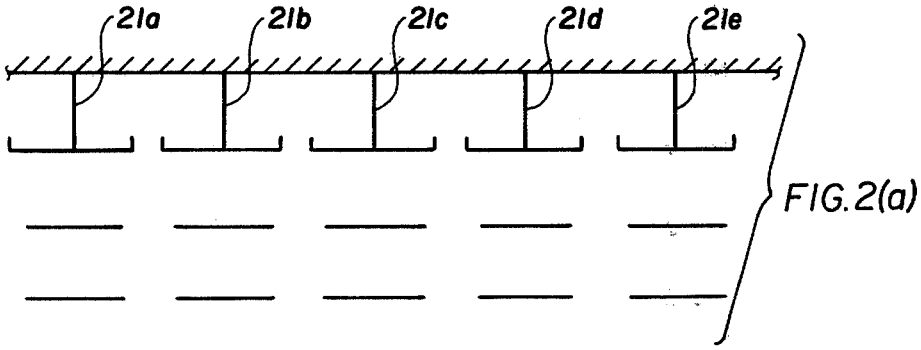
FIGS. 2(*a*) and (*b*) are schematic representations of a conventional E-plane array of yagi end-fire elements showing the direction of scan.
Figure 2B:
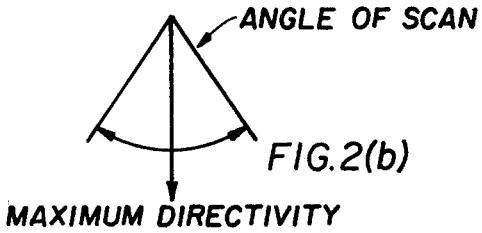

FIG. 2(*a*) illustrates a linear array of hooked yagi elements numbered 21(*a*)–(*e*), with each of the elements being positioned side by side in the same relative plane (E-plane), having maximum directivity in direction perpendicular to that plane as shown in FIG. 2(*b*).

Figure 3A:
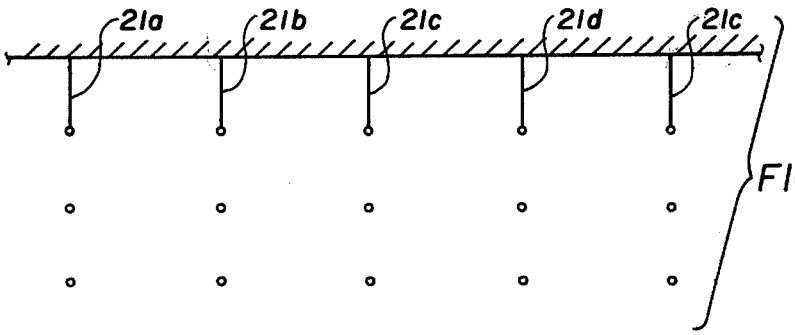
FIGS. 3(*a*) and 3(*b*) are a schematic representation of an array of yagi end-fire elements arranged in a parallel manner in the H-plane showing the direction of scan.
Figure 3B:
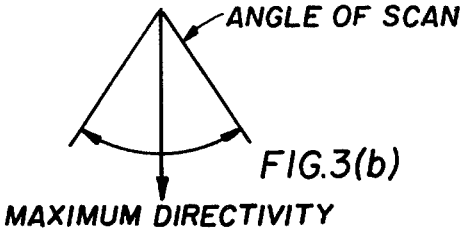

By comparison, FIGS. 3(*a*) and (*b*) illustrate a comparable antenna system wherein each of the elements 21(*a*)–(*e*) is rotated 90° so as to be longitudinally parallel to each other. This arrangement is defined as an H-plane array having maximum directivity and scanning capacity as shown in FIG. 3(*b*).

Figure 4A:
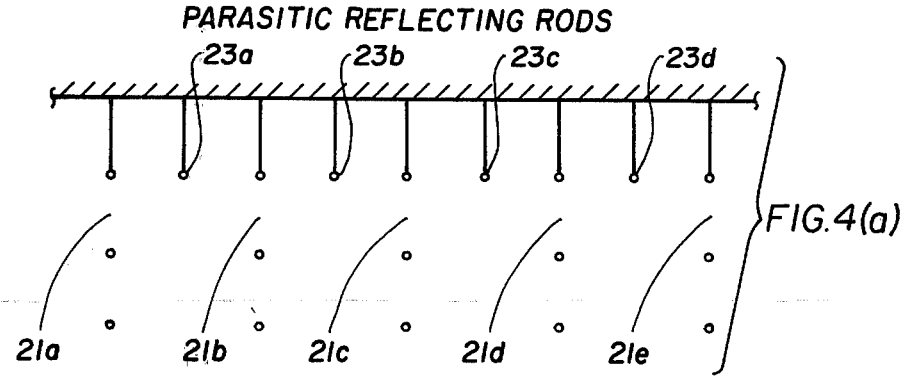
FIGS. 4(*a*) and (*b*) are schematic representations of an H-plane yagi array including parasitic reflecting rods in accordance with the present invention, also indicating the direction of scan.
Figure 4B:
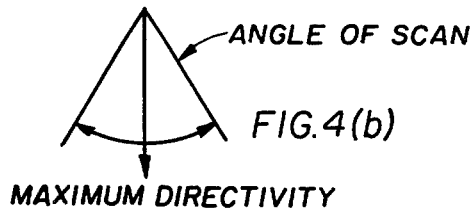
Figure 5:
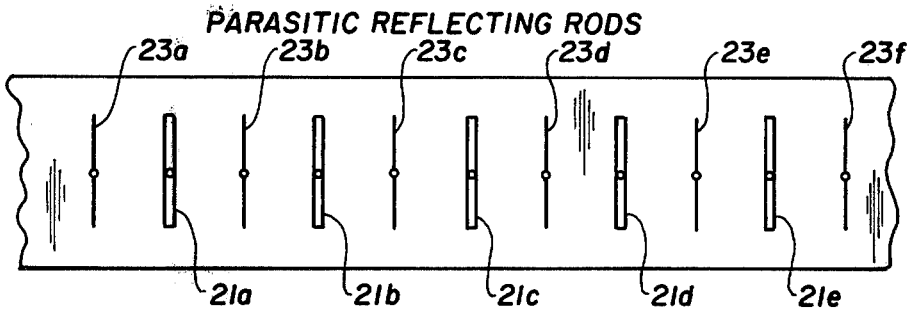
FIG. 5 is a front elevational view of representation of FIG. 4.
Figure 6:
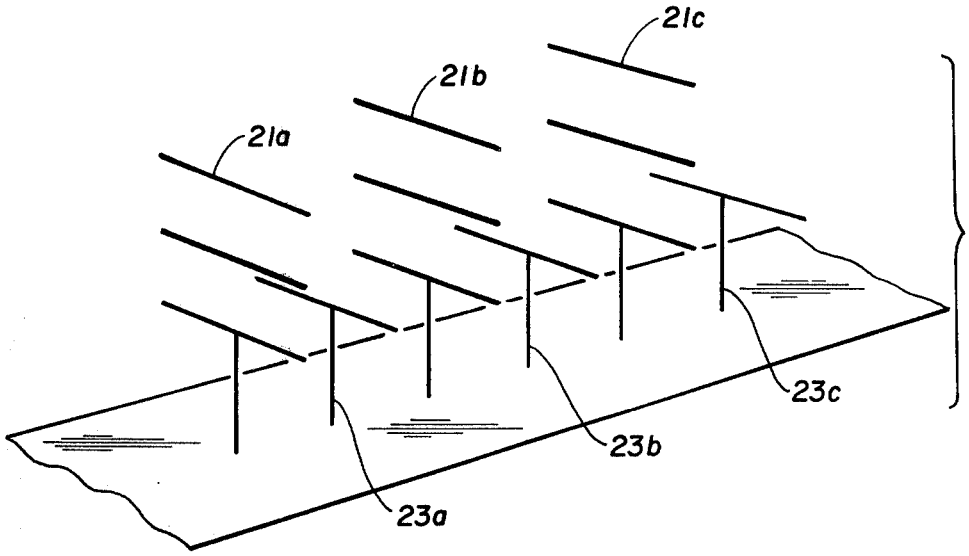
FIG. 6 is a perspective view of the representation of FIGS. 4 and 5.
Figure 7:
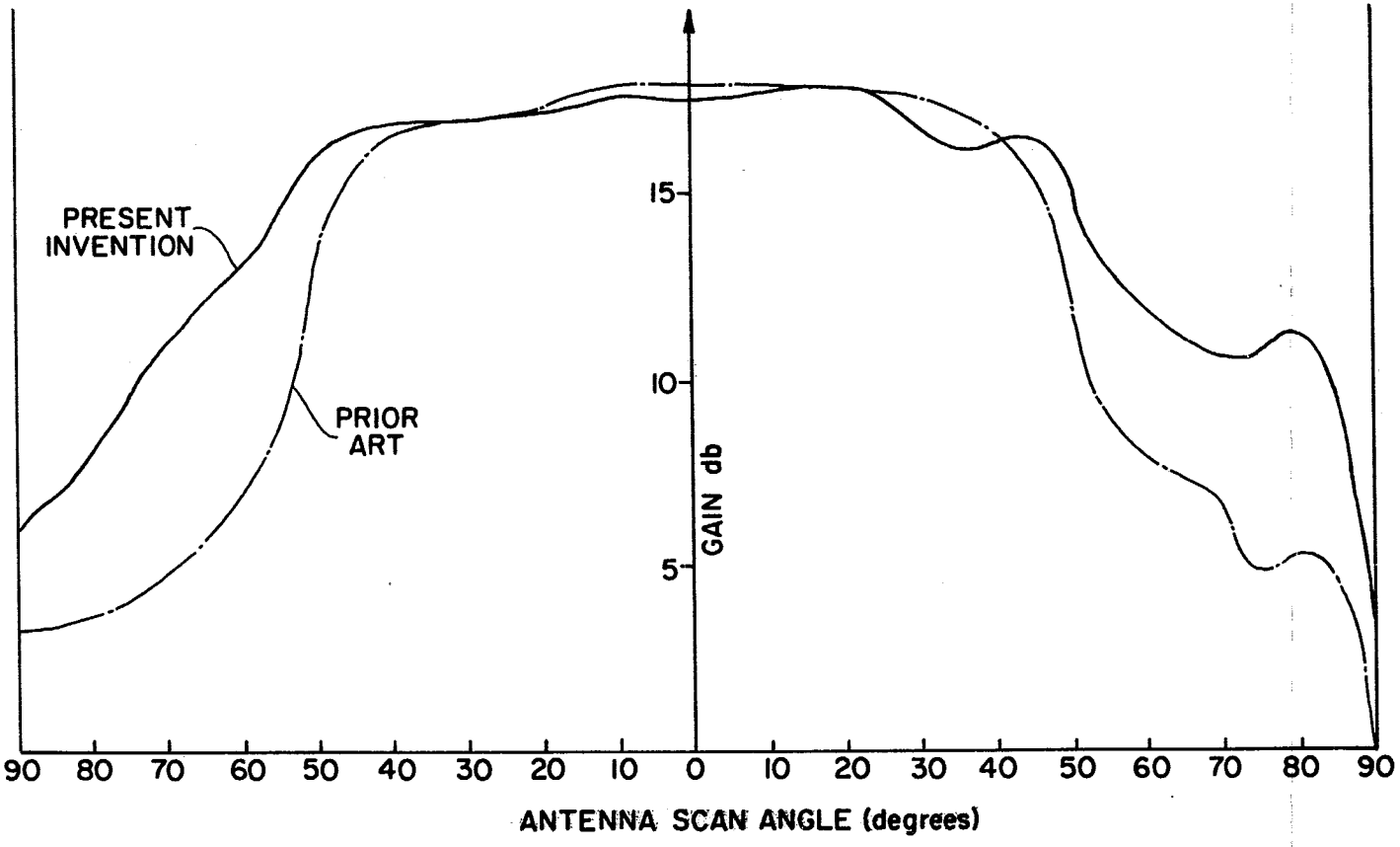
FIG. 7 is a graphical representation of the angular scanning capacity of the present invention as compared to that of a typical yagi end-fire array.

FIGS. 4, 5 and 6 illustrate an H-plane array of yagi end-fire elements similar to that of FIG. 3, further including a plurality of parasitic reflecting rods 23(*a*)–(*f*) positioned in spaced parallel relation to the individual elements in accordance with the present invention.

Typical spacing between adjacent drivers is approximately one-half wavelength. The distance between the ground plane and the drivers is of the order of one-fourth wavelength. As the inter-element spacing decreases, the effects of mutual coupling increase dramatically. Conventionally, an increase in mutual coupling mandates increased inter-element feed through thereby decreasing inter-element isolation. In order to allow for satisfactory scanning capacity however, the isolation between adjacent elements must be maintained at a high level. In the present invention, this is done by the selective use of parasitic reflecting rods.

It should be noted that the aim of the present system is not the elimination of inter-element mutual coupling which is required for wide-angle electronic scanning. Such a result would encourage the individual elements to act as if each was in free space rather than an array, and consequently, limit the angle through which the array can be scanned. Instead, the present invention provides apparatus to minimize the energy that enters the antenna ports due to radiation from adjacent drivers. This inter-element isolation does imply the elimination of mutual coupling.

Adjacent drivers are still excited by their adjacent counterparts although the use of parasitic reflecting rods alters the phase and amplitude of the coupling field as to allow this energy to be reradiated by the adjacent driver rather than passing into the antenna port of the adjacent element. Increased isolation therefore permits a reduction to the energy loss associated with mutual coupling.

Figure 8:
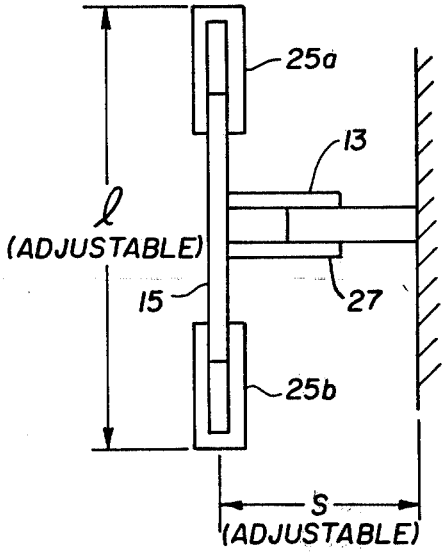
FIG. 8 is an illustration of a parasitic rod in accordance with the present invention showing the adjustable length and spacing of the rod.

As shown in FIG. 8, this constructive reradiation is accomplished by selecting the length, l, and spacing, s, of the parasitic rods so that the phase and amplitude of the coupling field may be constructively combined with the field pattern of the adjacent element. The result of the system is more constant element impedance and equal radiation throughout a larger sector of the element field pattern.

The parasitic reflecting rods 23(*a*)–(*f*) should preferably be thin dipoles such that only one mode is excited by the rods. Thicker dipoles may be used although this results in the production of additional modes which must be carefully monitored to prevent radiation irregularities and cross-polarization of the field.

Through the use of the present invention, inter-element isolation improves from approximately 12 dB to 20 dB. This increased isolation reduces non-uniformities in system impedance at various scan angles, consequently allowing broadening of the element pattern by about 20° as shown in FIG. 8. The system is therefore scannable over a ninety degree (90°) sector with virtually no decrease in antenna gain. Transmission efficiency is thereby preserved.

Figure 9:
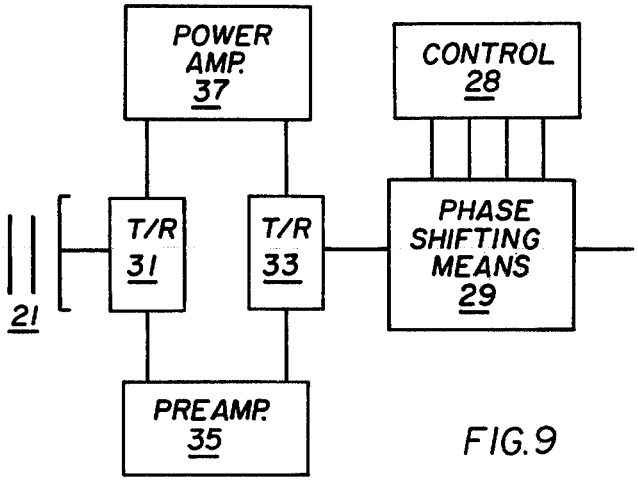
FIG. 9 is a schematic representation of electrical signal generating/receiving means which may be used in conjunction with the present invention.

FIG. 9 is a schematic representation of electrical signal generating/receiving means which may be used in conjunction with the present invention. Control module 28 directs the operation of phase shifting means 29. Transmit/receive modules 31 and 33 pass the signal between the antenna element 21 and phase shifting means 29 depending upon whether the nature of the signal (transmit or receive signal). Pre-amp 35 amplifies signals received by the system while power amp 37 amplifies signals to be transmitted by the system.

Figure 10:
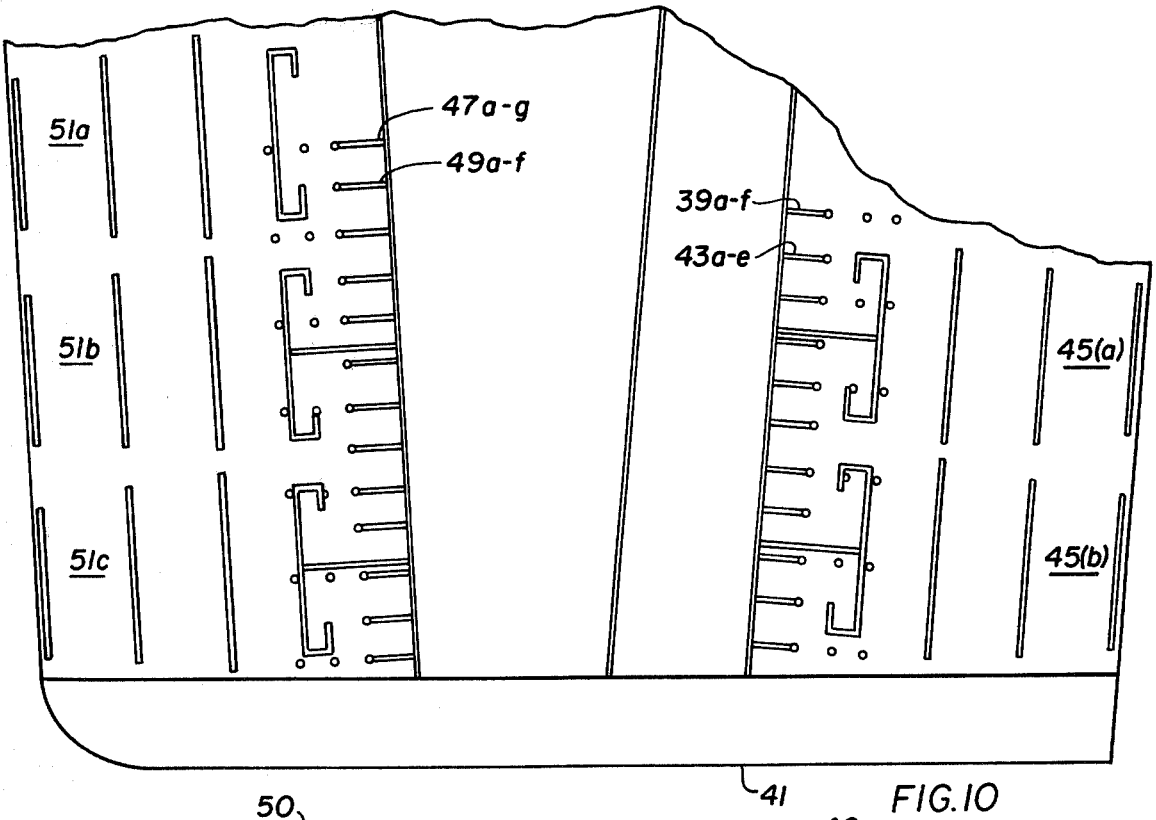
FIG. 10 is a sectional view of one embodiment of the invention shown mounted within an aircraft wing.
Figure 11:
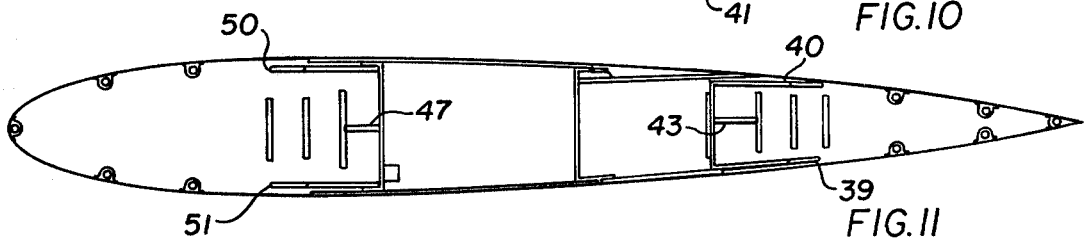
FIG. 11 is an elevational view of the embodiment shown in FIG. 10.

FIGS. 10 and 11 are views of one embodiment of the invention illustrating the use of the invention in combination with an E-plane array positioned within an aircraft wing. Elements 39(*a*)–(*f*) are shown arranged in an H-plane array near the trailing edge of wing 41. Parasitic reflecting rods 43(*a*)–(*e*) are shown positioned adjacent to elements 39. Elements 45(*a*) and (*b*) are a representative portion of an E-plane array attached to the same ground plane as elements 39 near the trailing edge of wing 41. A similar configuration is shown in the leading edge of the wing including an H-plane array of elements 47(*a*)–(*g*) and reflecting rods 49(*a*)–(*f*) in conjunction with an E-plane array of elements 51(*a*)–(*c*).

FIG. 10 illustrates the use of multiple E-plane arrays stacked vertically. In the wing leading edge, this configuration is represented by E-plane elements 50 and 51. In the trailing edge, the representative elements are designated 39 and 40.

The system illustrated in FIGS. 10 and 11 is scannable in both the E- and H-planes. The E-plane arrays produce a horizontally polarized beam while the H-plane arrays result in a vertically polarized beam. The intra-element spacing in each array is related to operative frequency of each array. The closer spacing in the H-plane arrays is therefore a result of the higher operative frequency of the H-plane array in this embodiment.

Although the invention has been described in connection with I.F.F. systems, it will be apparent to one skilled in the art that it may also be used in connection with directive radar, transmission beams, passive receiving systems or in any application where a vertically polarized beam is desired. Therefore, it is intended that no limitations be placed on the invention except as defined by the scope of the appended claims.

What is claimed is:

1. An antenna system construction mounted in the wing of an airfoil comprising:
- a leading H-plane array of directional elements mounted in the leading edge of an aircraft wing,
- a trailing H-plane array of directional elements mounted in the trailing edge of the aircraft wing,
- a plurality of parasitic reflecting rods, said rods being interposed in spaced relation to said elements in each of said forward and said trailing H-plane arrays, said rods being dimensioned and spaced from said H-plane directional elements as to regulate the mutual coupling between elements of said H-plane arrays such that high interelement isolation is maintained throughout a broad angular sector,
- an E-plane array of directional elements mounted in the leading edge of the aircraft wing adjacent to said leading H-plane array,
- an E-plane array of directional elements mounted in the trailing edge of the aircraft wing adjacent to said trailing H-plane array,
- means for applying electrical signals to each of said arrays, and
- means for shifting the relative phase of said signals in response to a desired direction of scan.

2. An antenna system construction mounted in the wing of an airfoil comprising:
- an H-plane array of directional elements mounted in the leading edge of an aircraft wing,
- a pluality of parasitic reflecting rods, said rods being interposed in spaced relation to said elements in said H-plane array, said rods being dimensioned and spaced from said H-plane directional elements as to regulate the mutual coupling between elements of said H-plane array such that high interelement isolation is maintained throughout a broad angular sector,
- an E-plane array of directional elements mounted in the leading edge of the aircraft wing adjacent to said H-plane array,
- means for applying electrical signals to each of said arrays, and
- means for shifting the relative phase of said signals in response to a desired direction of scan.

3. An antenna system construction mounted in the wing of an airfoil comprising:
- an H-plane array of directional elements mounted in the trailing edge of an aircraft wing,
- a plurality of parasitic reflecting rods, said rods being interposed in spaced relation to said elements in said H-plane array, said rods being dimensioned and spaced from said H-plane directional elements as to regulate the mutual coupling between elements of said H-plane array such that high interelement isolation is maintained throughout a broad angular sector,
- an E-plane array of directional elements mounted in the trailing edge of the aircraft wing adjacent to said H-plane array,
- means for applying electrical signals to each of said arrays, and
- means for shifting the relative phase of said signals in response to a desired direction of scan.

4. The system as recited in claim 2 or 3 wherein said directional elements comprise a plurality of yagi end-fire elements, each of said end-fire elements, including an excitable driver, a plurality of parasitic directors and a common reflector, said reflectors and said driver being arranged in a longitudinally parallel manner in a common plane and spaced a predetermined distance from each other and from said common reflector.

5. The system as recited in claim 2 or 3 wherein said parasitic reflecting rods are offset from said common reflector a distance approximating that between said driver and said common reflector, said rods also being oriented parallel to said drivers.

6. The system as recited in claim 2 or 3 further including means for adjusting the length and spacial orientation of said rods as to control the phase and amplitude of said mutual coupling energy.

7. The system as recited in claim 2 or 3 wherein said drivers are hooked on their longitudinal ends.

8. The system as recited in claim 2 or 3 wherein said parasitic reflecting rods are positioned in the same vertical plane as said drivers.

9. The system as recited in claim 2 or 3 further including adjustable spacing means to permit the adjustment of the spacing between said common reflector and said parasitic reflecting rods.

10. The system as recited in claim 2 or 3 further including means for adjusting the length of said parasitic reflecting rods.

11. The system as recited in claim 2 or 3 wherein the length of said parasitic reflecting rods and the distance between said common reflector and said rods are adjustable to values which in the operation of said system regulate a scattering field in the vicinity of said rods, said field being variable in phase and amplitude in response to said length and distance adjustments as to increase inter-element isolation.

12. The system as recited in claim 2 or 3 further including means for adjusting the length of said rods and the spacing between said rods and said common reflector so as to regulate a scattering field at the antenna aperture, said field being variable in phase and amplitude as to increase isolation between said elements.

13. The system as recited in claim 2 or 3 further including means for adjusting the length of said rods and means for adjusting the spacing between said rods and said common reflector, said first and second means being adjustable in combination so as to create an electronic scattering field when said elements are excited, said scattering field serving to enhance inter-element isolation and to increase the angular sector scannable by said system.

14. The system as recited in claim 2 or 3 wherein said parasitic reflecting rods are electrically isolated from said elements.

15. An antenna system construction mounted in the wings of an airfoil comprising:

a forward H-plane array of directional elements mounted in the forward edge of each wing, a trailing H-plane array of directional elements mounted in the trailing edge of each wing, a plurality of parasitic reflecting rods, said rods being interposed in spaced relation to said elements in each of said forward and said trailing H-plane arrays, a pair of forward E-plane arrays of directional elements mounted in the forward edge of each wing in spaced parallel relation on opposite sides of said forward H-plane arrays, a pair of trailing E-plane arrays of directional elements mounted in the trailing edge of each wing in spaced parallel relation on opposite sides of said trailing H-plane arrays, means for applying electrical signals to each of said arrays, means for shifting the relative phase of said signals in response to a desired direction of scan, and means for varying the length and spacial orientation of said rods as to regulate the mutual coupling energy between elements of said H-plane arrays such that high inter-element isolation is maintained throughout a broad angular scanning sector.

* * * * *